United States Patent [19]

Brockway et al.

[11] Patent Number: 4,559,955

[45] Date of Patent: Dec. 24, 1985

[54] CONTROLLED AIR BLEED CIGARETTE HOLDER

[76] Inventors: Bert R. Brockway, 3648 N. Pine Grove Ave., Chicago, Ill. 60613; Stephen R. Arnold, 2352 Ohio St., Lisle, Ill. 60532

[21] Appl. No.: 506,007

[22] Filed: Jun. 20, 1983

[51] Int. Cl.[4] ..... A24F 7/02; A24F 7/04

[52] U.S. Cl. ..... 131/198.2; 131/336

[58] Field of Search ..... 131/336, 198 A, 198 R

[56] References Cited

U.S. PATENT DOCUMENTS 3,695,274 10/1972 Summers ..... 131/198 A 4,190,063 2/1980 Turner ..... 131/198 A

*Primary Examiner*—V. Millin

*Attorney, Agent, or Firm*—Stephen R. Arnold; Russell E. Hattis

[57] ABSTRACT

A cigarette holder has internal valving means for providing with each inhalation by the smoker an initial supply of substantially smoke-free air, followed by a vacuum actuated changeover to supply smoke directly from the cigarette without dilution. The initial precursor of substantially smoke-free air has a minimizing effect on the irritating properties of the inhaled cigarette smoke. An alternative embodiment incorporates the valving means directly into the end of the cigarette during manufacture.

9 Claims, 7 Drawing Figures

CONTROLLED AIR BLEED CIGARETTE HOLDER

TECHNICAL FIELD OF THE INVENTION

The technical field of the invention is cigarette holders and cigarette filters, in particular air bleed systems for cigarette smoke dilution.

BACKGROUND OF THE INVENTION

The irritating properties of cigarette smoke on the respiratory system of the smoker have long been known. A variety of approaches have been undertaken so as to minimize the risk of respiratory deseases as emphysema and lung cancer commonly associated with habitual smoking. A great many individuals appear to be unable to stop smoking, and a variety of means have been employed to reduce the risks of smoking. Various tar filters have been appended to cigarettes in the form of integral filters, or have been incorporated into cigarette holders for purposes of minimizing the irritating properties of cigarette smoke. Such filters generally have subjective effect of reducing the flavor of the smoke and hence the enjoyment to the smoker.

An alternative approach has been to employ a series of perforations, most typically on an integral filter on the end of a cigarette, whereby air is constantly bled into the smoke during inhalation. Such filters serve to cool the smoke to a degree, but the dilution action also adversely affects the subjective flavor sensation, and as a result such filters are considered by many smokers to be an unsatisfactory solution. For individuals unable or unwilling to stop smoking completely, a useful contribution to the art would be a cigarette filter providing a substantial reduction in such irritation, while preserving the flavor of the cigarette.

SUMMARY OF THE INVENTION

According to a feature of the invention, a valving means associated with a cigarette is provided with a metering air bleed valve which provides each inhalation (inspiration) with an initial phase characterized by substantially smoke-free air, and thereafter for a portion of the remainder of the inhalation phase providing a feed from the cigarette. Thus, an initial volume of substantally smoke-free air is drawn into the lungs to provide a smoke-free boundary layer in the sacs thereof, and to cause a general smoke dilution effet by causing during initial inspiration an inflation of the sacs with smoke-free air so as to provide a reduction in the irritating properties of the full strength smoke arriving immediately thereafter. Moreover, by actuating the valving means at a delayed time with respect to initiation of inspiration, a net reduction in the total amount of smoke delivered to the lungs is achieved. According to a specific feature of the invention, the valving means is actuated by a change in inhalation vacuum level above an initial threshold value to cause initially open air bleed ports to be sealed off, and thereafter to open smoke passages allowing smoke directly from the cigarette to be fed to the mouth without such dilution.

According to a further specific feature of the invention, the valving means is incorporated into a cigarette holder, and in the preferred form is configured as a differential piston valve.

According to another specific feature of the invention, the valving means is built into the tip of a cigarette, and in the preferred form employs a simple velocity-actuated flap valve mounted on a small spool.

Other features and advantages of the invention will become apparent upon making reference to the description to follow, the drawings, and the claims.

DESCRIPTION OF THE INVENTION

The subject matter of the invention is automatic valving means to be used in conjunction with a cigarette, the valving means being described in two forms, one being a valving cigarette holder, the other being simple integral valve designed to be manufactured directly into the downstream end of a cigarette. Throughout this application and in the claims thereof, the term "downstream end" of a cigarette will be used to denote the non-burning end thereof. The purpose of either version is to provide during the initial phase of each inhalation (inspiration) from a cigarette substantially smoke-free air to the mouth and lungs so as to provide for an initial partial filling of the sacs of the lungs with smoke-free air followed thereafter by an undiluted flow from the cigarette, so as to provide in the mouth and lungs a dilution effect of the full strength smoke and to provide an increased boundary of stagnant air at the walls of the sacs, thereby reducing irritation to the lungs when the full strength smoke is drawn thereinto.

In either of the preferred embodiments the valving means is arranged such that initial inhalation vacuum to the mouthpiece draws outside air into the mouthpiece, after which time a movable valve member seals off the inlet air bleed to allow outside air to be drawn directly through the cigarette to provide undiluted smoke to the mouth. By providing the smoker with such a precursor of substantially smoke-free air with each inhalation, a reduction of irritation to the sensitive tissues of the interior of the lungs is achieved. By this means, it is believed that a reduction in the risk of disease attended to such irritation will be substantially achieved.

Figure 1:
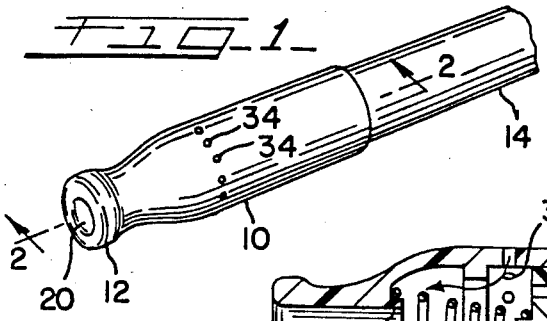
FIG. 1 is a perspective view of a cigarette holder embodiment of the invention, showing air bleed passages.
Figure 2:
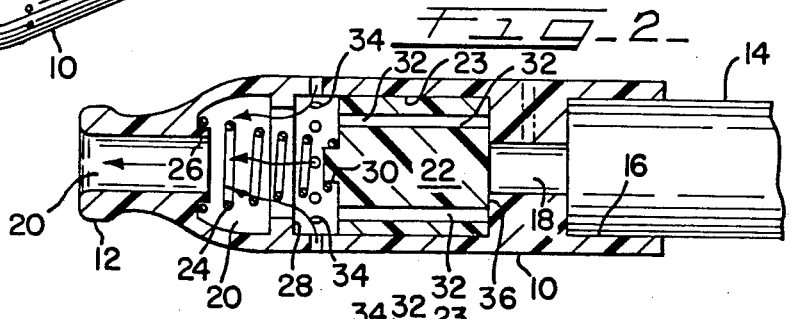
FIG. 2 is a cross section view of the cigarette holder of the invention showing a spring loaded piston and exposed air bleed inlet passages communicating with a cigarette holder mouthpiece.
Figure 3:
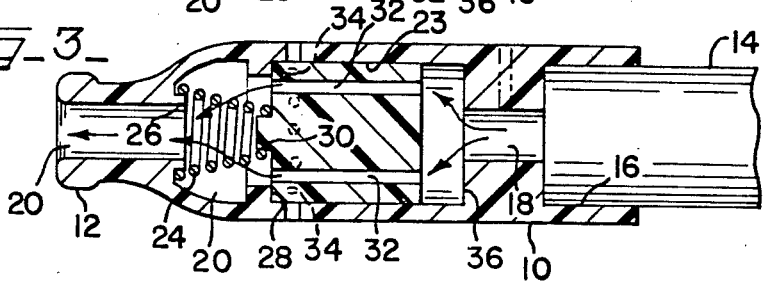
FIG. 3 shows the cigarette holder of FIG. 2 under conditions of slightly higher inhalation vacuum, showing the piston withdrawn under vacuum to cover the air bleed passages and in a configuration to allow through passage of smoke from the cigarette to the mouthpiece.

Considering the first embodiment of the invention in more detail, FIGS. 1, 2, and 3, show views of a generally cylindrical cigarette holder body 10 having a mouthpiece 12 shown with a cigarette 14 inserted into an insertion pasage 16 at the inlet end of the body. The holder 10 is provided with an interior bore-containing a slidable piston 22 mounted therein. The piston 22 is provided with one or more axially disposed passages 32 within the length thereof. In the absence of inhalation vacuum at the mouthpiece 12 and communicated to the exit passage 20 (mouthpiece port means), the piston 22 is lightly held by pressure from a conical piston spring 24 engaging a spring centering pin 30 to hold the piston lightly in contact with a sealing face 36 of the housing 10. It will be noted that the passages 32 are disposed to terminate against the sealing face 36, so that in the position shown in FIG. 2, the passages are effectively sealed at their rightmost end.

Under such conditions, a light inhalation vacuum applied to the mouthpiece and communicated to exit passage 20 causes outside air to enter the exit passage through air bleed passages 34 disposed in the walls of the housing 10 to the left of the left face of the piston 22. Thus, during the initial phase of inhaling through the cigarette holder a quantity of substantially smoke-free air is drawn into the mouth of the smoker. A further rise in inhalation vacuum causes the vacuum condition existing at the left-most face of the piston 22 to overcome the light retention pressure of spring 24, forcing the piston to the left to come to bear against piston ridges 28 as shown in FIG. 3.

Referring FIG. 3, it will be noted that in this configuration the axial passages 32 of the piston 22 are clear at both ends, and thus unattenuated smoke from the cigarette 14 passes through a smoke passage 18 communicating with the insertion passage 16, through piston passages 32, and into exit passage 20, and thence to the mouth of the smoker. It will also be noted that the leftward motion of the piston 22 in this valving condition seals off the air bleed passages 34, so that in the second phase of inhalation the smoke from the cigarette 14 goes directly to the smoker's mouth without dilution.

To avoid valve chatter when the piston 22 moves to the left, thereby allowing smoke filled air to enter the exit passage 20 via passages 32 in the piston and 18 in the holder body, and thus tending to reduce the leftward directed force on the piston, the diameter of the piston is configured substantially greater than the entry passage 18, and fits sealing against the rightmost wall 36 of the bore, as shown in FIG. 2, thereby effectively sealing off the by-pass passages 32 in the piston. Thus, although initial motion to the left of the piston 22 opens communication via by-pass passages 32 to the exit passage 20, it will be noted that the effective area on the rightmost end of the piston 22 is now substantially increased insofar as net effective piston area is concerned. This is a well known property of differential pistons, and if the by-pass passages 32 are configured sufficiently small, the net result of leftward piston travel of the piston 22 is to increase the leftward seating pressure of the piston against the piston ridge 28. By this means, piston chatter or improper actuation during intermediate motion thereof is eliminated.

FIGS. 4–7 show an alternative embodiment of the invention wherein the valving means is incorporated directly into the end of a cigarette. It will be noted that at the downstream end of the cigarette 10 is disposed a conventional filter 44 to which is abutted at the outermost end thereof a spool 40 having an axial passage 56 passing therethrough and communicating with the filter, the spool being provided with a circumferential groove 48 in the outer periphery thereof. An end wrap 42 of the cigarette is of conventional design and extends from the end of the cigarette 10 to hold the filter end 44 and the spool 40 secured together on the end of the cigarette.

Figure 4:
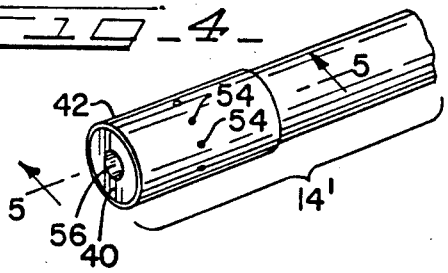
FIG. 4 is a perspective view of an alternative embodiment of the invention showing an air bleed valving means disposed on integral spool attached to the end of a cigarette and fabricated therewith.
Figure 7:
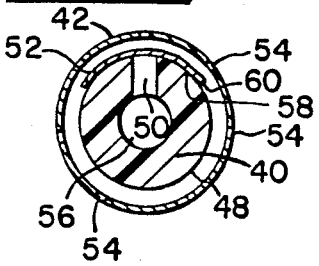
FIG. 7 is similar to FIG. 6 and shows the valve of FIG. 6 in the closed condition held in place by inhalation vacuum.
Figure 5:
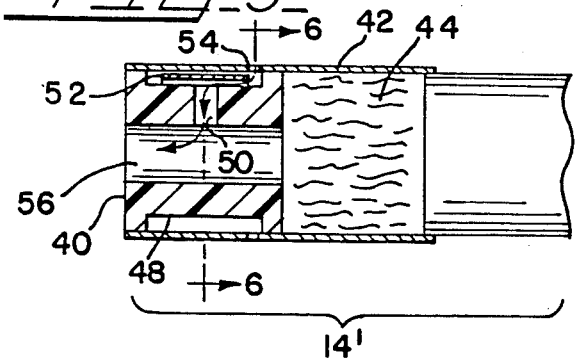
FIG. 5 is a cross section view of the valving means of FIG. 4 showing the valve in the open position.
Figure 6:
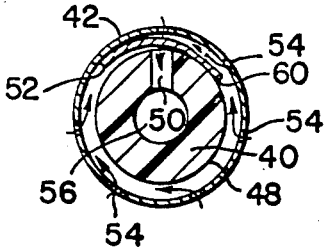
FIG. 6 is a cross section end view of the valving means of FIG. 4, showing the valve in the open position, the valve including a resilient flap attached to a flat on a spool having a central passage therethrough and a passage communicating with the exterior thereof directly under the flap.

Passing through the wrap end 42 close to the interface between the filter 44 and the spool 40 are diposed a number of air bleed passages 54 (see also FIG. 4). Referring particularly to FIGS. 5, 6, and 7 a passage 50 is centrally located in the body of the spool 40 and is disposed radially therein to communicate between the groove 48 and the interior passage 56. A resilient flap 52 made of a thin sheet of plastic, paper or similar material is attached to a flat 58 disposed on the surface of the groove 48 at a distance from the passage 50, the flap 52 being secured at one end to the flat by any conventional adhesive means, here shown attached by a conventional glue layer 60.

The flap 52 is of sufficient length to extend past the passage 50, the free end of the flap being curlingly retained at a standoff distance outward from the groove 48 by engagement with the interior of the end wrap 42, so that an air passage exists between the outer end of passage 50 and the flap in the relaxed state thereof. The flap 52 may be of any material sufficiently resilient to cause it to stand outward from the groove and the passage 50 in the relaxed state.

Upon inspiration by the smoker through the axial passage 56, air passage through the air bleed holes 54, initially flowing under weak vacuum, passes through the air bleed holes to flow under the wrap 42 to pass through the port 50 and thereafter out to the mouth through port 56. During the initial phases of inspiration, this constitutes the principal air flow to the mouth, and is substantially smoke-free.

As the inhalation vacuum applied by the mouth to port 56 increases during inspiration, however, by well known principles the sideways flow of air under the flap 52 increases in velocity, causing a local reduction in pressure, causing the flap 52 to be drawn downward to arrestingly engage along substantially its entire length the spool groove 48 resulting in a sealoff of port 50 as shown in FIG. 7. Thereafter, throughout a substantial remainder of the inspiration, the flow of ambient air into the mouth through passage 56 is sealed off, and the draw from the cigarette is entirely through the cigarette itself. By proper adjustment of the size of the air bleed holes 54 and the axial passage 56, the initial flow can be substantially smoke-free.

Thus, either version of valving means, whether as a separate cigarette holder as shown in FIGS. 1–3, or in the form of an integral flap valve as illustrated in FIGS. 4–7, accomplishes the desired purpose, namely to provide during the initial phases of inspiration substantially smoke-free air to the mouth and lungs, to be followed thereafter by a direct draw on the cigarette itself. This accomplishes a partial filling of the sacs of the lungs initially with substantially smoke-free air so as to provide at least a dillution of the total of amount of smoke admitted thereto, and also to provide a stagnant boundary layer of substantially pure air immediately thereagainst, so as to minimize the transfer of cigarette smoke to the walls of the sacs themselves. By this means a measure of protection against lung irritation caused by cigarette smoking is achieved.

It is evident that a great variety of valving means may be used to accomplish this objective, and only two versions are disclosed herein. Alternative valving systems based upon known principles may readily be adapted. Thus, for example, instead of causing valving changeover to occur as the inspiration vacuum rises beyond a certain threshold level, as set by effective piston diameter and spring tension in the first embodiment, or by flap resiliency and standoff distance in the second embodiment, the changeover may, for example, be effectuated on a total flow basis.

Thus, with respect to the embodiment shown in FIGS. 1-3, a suitably modified piston having an outer threaded surface engaging the piston bore 23 could be driven to rotation by inspiration flow by means of a propellor type arrangment of vanes mounted in a central axial passage therein, the piston driven to rotation during inspiration to move laterally so as to effect valving changeover as a result of its position. In this case the net travel of the piston would be determined principally by the total flow of air through the piston, the changeover being arranged such that after a prescribed initial volume has passed through, the associated valving means would shut down entry of outside air valve return may be accomplished by a weak spring supplying counter-torque to the rotator. A variety of such volume-flow valving changeover means may be derived from conventional mechanisms well known in the art.

Thus, there have been described a variety of system for providing an initial quantity of substantially smoke-free air to the smoker during an initial phase of each inspiration on a cigarette, with the objective of minimizing irritation to the sensitive sacs of the lungs, and to reduce the concommitant adverse physiological effects of smoking on the lungs of the smoker. Moreover, by actuating the valving means at a delayed time with respect to initiation of inspiration, a net reduction in the total amount of smoke delivered to the lungs is achieved.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out the invention, but that the inventions will include all embodiments falling within the scope of the appended claims.

I claim:

1. An air bleed apparatus for use in conjunction with a cigarette or the like, said apparatus comprising:

a mouthpiece having an inlet end for communicating with said cigarette or the like and having mouthpiece port means for communicating inspiration vacuum from the smoker's mouth to said inlet end;

air bleed port means for admitting ambient air to said mouthpiece portion means; and valving means operable between first and second valving conditions for automatically communicating said mouthpiece port means in said first valving condition to said air bleed port means during an initial phase of each inspiration and thereafter during the same inspiration said valving means automatically shifting to said second valving condition so as to communicate said mouthpiece port means substantially only to said inlet end, so that during each initial phase of each inspiration a quantity of ambient air is supplied to the mouth from said air bleed port means, said valving means automatically setting to said first condition before the substantive process of the next inspiration.

2. The air bleed apparatus of claim 1 wherein said apparatus is configured as a cigarette holder separable from said cigarette or the like at said inlet end so as to removably sealingly accept said downstream end of a cigarette.

3. The air bleed apparatus of claim 2 wherein said valving means includes threshold vacuum sensing means for sensing the vacuum level produced through said mouthpiece port means and for selectively actuating said valving means to said first valving condition when said vacuum level is negligibly small and to said second valving condition when said vacuum level is stronger than a given threshold value.

4. The apparatus of claim 3 wherein said valving means sealingly closes off flow from said inlet end to said mouthpiece port means when in said first valving condition.

5. The air bleed apparatus of claim 4 wherein said valving means includes spring means and piston means, said spring means urging said piston means to a first position corresponding to said first valving condition so as to sealingly obstruct flow from said inlet end to said mouthpiece port means and to allow said air bleed port means to communicate with said mouthpiece, said piston means being movably responsive to said vacuum level so as to be urged against the force of said spring means to a second position corresponding to said second valving condition when said vacuum level exceeds said given threshold value so as to sealingly obstruct said air bleed port means and allow said inlet end to communicate with said mouthpiece port means.

6. The air bleed apparatus of claim 1 wherein said apparatus is integral with a cigarette and said inlet end is fixedly communicatingly attached to the downstream end thereof.

7. The apparatus of claim 6 wherein wherein said valving means includes threshold vacuum sensing means for sensing the vacuum level produced through said mouthpiece port means and for selectively actuating said valving means to said first valving condition when said vacuum level is negligibly small and to said second valving condition when said vacuum level is stronger than a given threshold value.

8. The air bleed apparatus of claim 7 wherein said valving means includes flap means interposably disposable to block gas flow between said air bleed port means and said mouthpiece port means and includes resilient means for urging said flap means to a first open position allowing ambient air to flow therearound to enter said mouthpiece port means, said flap valving means being urged to a closed position against the force of said resilient means by the pressure of air thereagainst when said vacuum level is stronger than said threshold value so as to seal said air bleed port means against air flow to said mouthpiece port means.

9. The air bleed apparatus of claim 8 wherein said valving means comprises a spool-shaped extension axially affixed to the downstream end of said cigarette and having an axially disposed passage passing completely therethrough, a radially extending passage having outer and inner ends and communicating between said axially disposed passage and the groove extending peripherally around said spool, said flap means being generally sheet-formed and disposed about a portion of said groove surrounding the outer end of said radial passage and held away from and proximate thereto by said resilient means, said flap means being actuated to move against the force of said resilient means responsively to the vacuum level produced within said axially disposed passage to sealingly seat against said outer end of said axially disposed passage when said vacuum level exceeds said threshold value.

* * * * *